US010178467B2

(12) United States Patent
Hou et al.

(10) Patent No.: US 10,178,467 B2
(45) Date of Patent: Jan. 8, 2019

(54) THIN SPEAKER MODULE WITH A FRONT ACOUSTIC CAVITY

(71) Applicant: Goertek.Inc, Shandong (CN)

(72) Inventors: Jincai Hou, Shandong (CN); Mingjie Zhong, Shandong (CN)

(73) Assignee: Goertek Inc., Weifang, Shandong (CN)

( * ) Notice: Subject to any disclaimer, the term of this patent is extended or adjusted under 35 U.S.C. 154(b) by 0 days.

(21) Appl. No.: 15/540,194

(22) PCT Filed: Dec. 9, 2015

(86) PCT No.: PCT/CN2015/096751
§ 371 (c)(1),
(2) Date: Jun. 27, 2017

(87) PCT Pub. No.: WO2016/124041
PCT Pub. Date: Aug. 11, 2016

(65) Prior Publication Data

US 2017/0353783 A1 Dec. 7, 2017

(30) Foreign Application Priority Data

Feb. 3, 2015 (CN) ..... 2015 2 0075934 U

(51) Int. Cl.
*H04R 9/02* (2006.01)
*H04R 1/28* (2006.01)
(Continued)

(52) U.S. Cl.
CPC ..... *H04R 1/2803* (2013.01); *H04R 1/2873* (2013.01); *H04R 9/02* (2013.01);
(Continued)

(58) Field of Classification Search
CPC ..... H04R 1/2803; H04R 1/2873; H04R 9/06; H04R 9/025
See application file for complete search history.

(56) References Cited

U.S. PATENT DOCUMENTS 9,363,586 B2 * 6/2016 Fincham ..... H04R 1/02
2008/0159582 A1 7/2008 Kawasaki-Hedges et al.
2011/0182463 A1 * 7/2011 Lee ..... H04R 9/025 381/412

FOREIGN PATENT DOCUMENTS

CN 101711005 A 5/2010
CN 103686494 A 3/2014
(Continued)

OTHER PUBLICATIONS

International Searching Authority, International Search Report (ISR) and Written Opinion for International Application No. PCT/CN2015/096751, Mar. 9, 2016, 10 pages, State Intellectual Property Office Of The P.R.C., China.

*Primary Examiner* — Brian Ensey
(74) *Attorney, Agent, or Firm* — Alston & Bird LLP

(57) ABSTRACT

A speaker module relates to the technical field of electroacoustic products, and comprises a lower module casing, an upper module casing and a steel sheet which are successively combined together. A speaker monomer is contained in a space enclosed by the lower module casing, the upper module casing and the steel sheet. The speaker monomer, the upper module casing and the steel sheet together enclose a front sound cavity of the module. The front sound cavity is in communication with a sound outlet hole of the module, and the sound outlet hole is located on a side part of the speaker monomer. A sheet is adhered inside the steel sheet, the thickness of the sheet being about 0.1 mm~0.2 mm and the material of the sheet being a soundproof material.

10 Claims, 3 Drawing Sheets

(51) Int. Cl.
*H04R 9/06* (2006.01)
*H04R 1/34* (2006.01)

(52) U.S. Cl.
CPC ..... *H04R 9/025* (2013.01); *H04R 9/06* (2013.01); *H04R 1/345* (2013.01); *H04R 2499/11* (2013.01)

(56) References Cited

FOREIGN PATENT DOCUMENTS

| | | | |
|---|---|---|---|
| CN | 104219607 | A | 12/2014 |
| CN | 204350291 | U | 5/2015 |

* cited by examiner

THIN SPEAKER MODULE WITH A FRONT ACOUSTIC CAVITY

CROSS REFERENCE TO RELATED APPLICATIONS

This application is a national stage application, filed under 35 U.S.C. § 371, of International Application No. PCT/CN2015/096751, filed Dec. 9, 2015, which claims priority to Chinese Application No. 201520075934.1, filed Feb. 3, 2015, the contents of both of which as are hereby incorporated by reference in their entirety.

BACKGROUND

The present invention relates to the technical field of electro-acoustic products, and more particularly, to a speaker module.

A speaker module as an important acoustic component in a portable electronic device is an energy transducer for converting an acousto-electric signal into an acoustic signal. The speaker module generally comprises a housing in which a single speaker piece is accommodated. The single speaker piece comprises a vibrating system and a magnetic circuit system. The vibrating system comprises a diaphragm and a voice coil which are jointed together. The magnetic circuit system comprises a washer, a magnet and a basin frame which are jointed together in sequence. The single speaker piece separates an inner cavity of the entire module into two cavities, i.e., a front acoustic cavity and a rear acoustic cavity. The front acoustic cavity is communicated with a sound aperture of the module. Sound emitted from the single speaker piece enters the front acoustic cavity and is emitted from the sound aperture. As the portable electronic device is designed to be thinner and smaller, the speaker module emitting sound laterally has to be designed to be thinner because the height thereof is limited by the overall thickness of the portable electronic device. In order to ensure that the module has better acoustic performance, the volume of the front acoustic cavity of the module becomes the key to the improvement of the acoustic performance of the module. For example, with respect to a module mounted in a thinner electronic device, a distance from an upper end surface of a single speaker piece to an outer surface of a module housing is only 0.64 mm, and at this height, to avoid resonance occurring in the front acoustic cavity, the front acoustic cavity located at the upper part of the single speaker piece can only be sealed with a 0.2 mm thick steel sheet. Because the thickness of the steel sheet is relatively small, the volume of the front acoustic cavity is increased, thereby leading to poor medium and high frequency performances of the module and further reducing the overall acoustic performance of the module.

BRIEF SUMMARY

In view of the above defects, the technical problem to be solved by the present invention is to provide a speaker module in which the medium and high frequency performances are good and the overall acoustic performance is high.

In order to solve the technical problems described above, the technical solution of the present invention is as follows:

a speaker module comprises a module lower housing, a module upper housing and a steel sheet which are jointed together in sequence. A single speaker piece is accommodated in a space enclosed by the module lower housing, the module upper housing and the steel sheet. The single speaker piece, the module upper housing and the steel sheet together enclose a front acoustic cavity of the module. The front acoustic cavity is communicated with a sound aperture of the module. The sound aperture is positioned in a lateral portion of the single speaker piece. A thin sheet, which is made of a sound insulation material and is 0.1 mm to 0.2 mm thick, is adhered to the inner side of the steel sheet.

A recess portion that extends towards an inner cavity of the module and is 0.1 mm to 0.2 mm deep is provided at a position, corresponding to the single speaker piece, of the steel sheet, and the thin sheet is adhered to a position where the recess portion is located.

The thin sheet is away from the sound aperture.

The thin sheet is 0.15 mm thick, and the recess portion is also 0.15 mm thick.

The sound insulation material is selected from one of PET, bakelite or Acrylic.

The steel sheet is adhesively jointed with the module upper housing. A joint portion which is recessed downwards is provided at a position where the module upper housing is jointed with the steel sheet. The steel sheet is adhered to the joint portion, where an outer surface of the steel sheet is flush with an outer surface of the module upper housing or is slightly lower than the outer surface of the module upper housing.

The sound aperture is provided in a lateral portion of the module upper housing. A gap which forms an adhesive accommodating slot is provided between a sidewall of the joint portion, close to the sound aperture side, and a sidewall of the steel sheet.

The single speaker piece comprises a single front cover piece and a single housing piece which are jointed together. A vibrating system and a magnetic circuit system are accommodated inside a space enclosed by the single front cover piece and the single housing piece. The single housing piece is of an annular structure having two open ends. The bottom of a basin frame of the magnetic circuit system is exposed to the lower open end of the single housing piece.

An outer surface of the bottom of the basin frame protrudes out of a lower end surface of the single housing piece. A mounting hole which is adaptive with the bottom of the basin frame is provided in a position, corresponding to the bottom of the basin frame, of the module lower housing. The bottom of the basin frame is positioned at the mounting hole, and the outer surface of the bottom of the basin frame is flush with the outer surface of the module lower housing.

A sidewall at one side of the single housing piece is provided with two wire outgoing slots, and two wires of a voice coil of the vibrating system extend out from the two wire outgoing slots respectively and are electrically connected with the FPCB.

After the above technical solution is adopted, the speaker module of the present invention has the beneficial effects:

The speaker module of the present invention comprises the module lower housing, the module upper housing and the steel sheet which are jointed together in sequence, the single speaker piece is accommodated in a space enclosed by the module lower housing, the module upper housing and the steel sheet; the single speaker piece, the module upper housing and the steel sheet together enclose the front acoustic cavity of the module; the front acoustic cavity is communicated with the sound aperture of the module, which is provided in the lateral portion of the single speaker piece; the thin sheet, which is made of a sound insulation material and is 0.1 mm to 0.2 mm thick, is adhered to the inner side of the steel sheet. Therefore, the thin sheet having this thickness ensures that no resonance occurs in the front acoustic cavity, while effectively reducing the volume of the front acoustic cavity, thereby improving the medium and high frequency performances of the module and further improving the overall acoustic performance of the module. Meanwhile, the speaker module of the present invention is an improvement made on the basis of the structure of the existing module, without the need to change a mold of a module housing, thereby improving the acoustic performance of the module while saving the cost.

The recess portion that extends towards the inner cavity of the module and is 0.1 mm to 0.2 mm deep is provided at a position, corresponding to the single speaker piece, of the steel sheet, and the thin sheet is adhered to a position where the recess portion is located. The recess portion is provided with a protrusion inside the front acoustic cavity to further reduce the volume of the front acoustic cavity. The joint of the recess portion which is 0.1 mm to 0.2 mm deep and the thin sheet which is 0.1 mm to 0.2 mm thick still does not cause resonance in the front acoustic cavity, thereby further improving the medium and high frequency performances of the module and enhancing the overall acoustic performance of the module.

Since the thin sheet is away from the sound aperture, it cannot affect the sound channel area at the sound aperture, thereby being capable of ensuring smooth flow of sound waves and also ensuring that the acoustic performance of the module is not affected.

The steel sheet is adhesively jointed with the module upper housing, the joint portion which is recessed downwards is provided at a position where the module upper housing is jointed with the steel sheet, and an outer surface of the steel sheet is flush with an outer surface of the module upper housing at the joint portion. Therefore, the joint portion which is recessed downwards reduces the thickness of the module, and simultaneously increases a contact area between the steel sheet and the module upper housing and enhances the joint strength between the steel sheet and the module upper housing.

The gap which forms the adhesive accommodating slot is provided between the sidewall of the joint portion and the sidewall of the steel sheet. Therefore, the adhesive accommodating slot is provided to increase the adhesive application amount between the steel sheet and the module upper housing to further enhance the joint strength between the steel sheet and the module upper housing, effectively reduce the probability of the steel sheet cracking or falling from the module upper housing, enhance the stability of the module and prolong the service life of the module.

The outer surface of the bottom of the basin frame protrudes out of the lower end surface of the single housing piece, the mounting hole which is adaptive with the bottom of the basin frame is provided in a position, corresponding to the bottom of the basin frame, of the module lower housing, and the outer surface of the bottom of the basin frame is flush with the outer surface of the module lower housing. Therefore, this structure effectively reduces the thickness of the module, making the module to meet the requirements of a thin, compact electronic device.

From the above, the speaker module of the present invention solves the technical problem of poor medium and high frequency performances of the speaker module of the prior art. The speaker module of the present invention has good medium and high frequency performances, high overall acoustic performance and small thickness while achieving good stability and long service life.

DETAILED DESCRIPTION OF VARIOUS EMBODIMENTS

The present invention will be further described as below in conjunction with drawings and embodiments.

A orientation "UPPER" involved in the description refers to a direction of a vibrating system of a single speaker piece. A orientation "LOWER" refers to a direction of a magnetic circuit system of the single speaker piece. An inner side involved in the description refers to one side located inside an inner cavity of the module.

Figure 1:
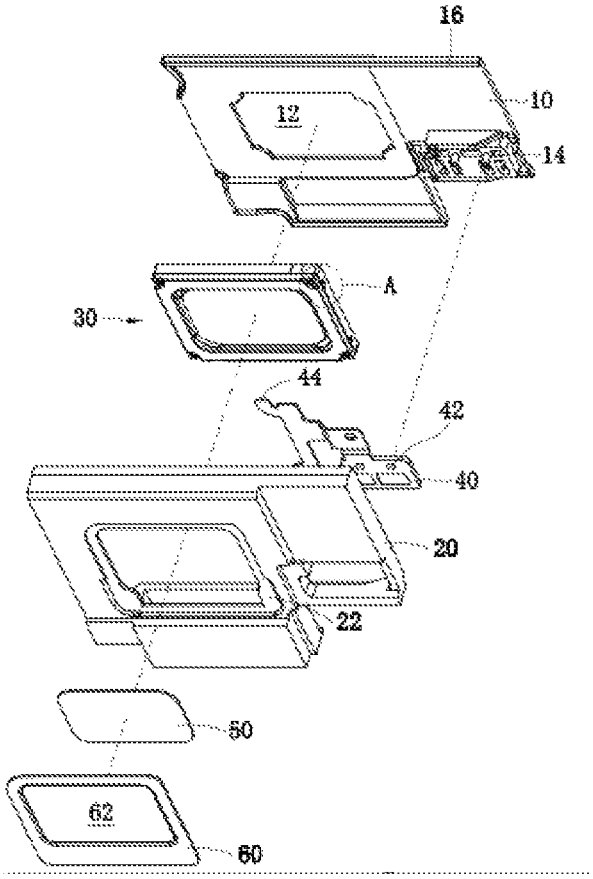
FIG. 1 is a stereoscopic exploded schematic structural view of a speaker module of the present invention.
Figure 3:
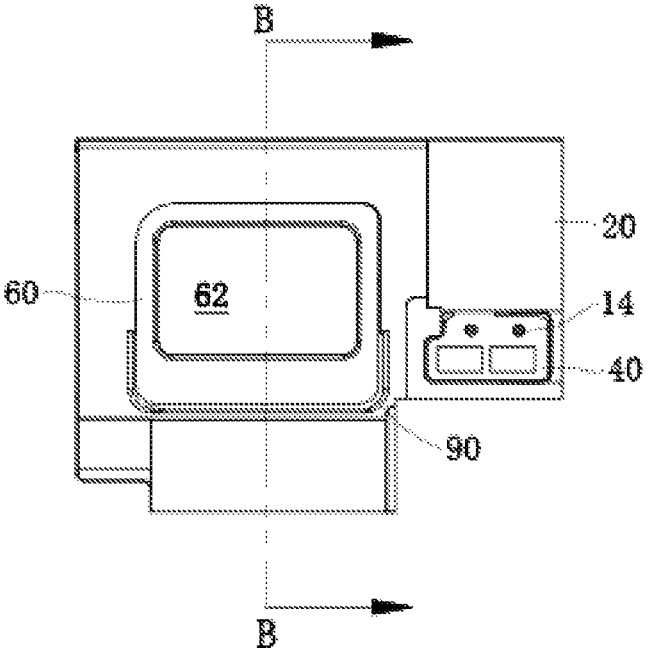
FIG. 3 is a combination view of FIG. 1.
Figure 4:
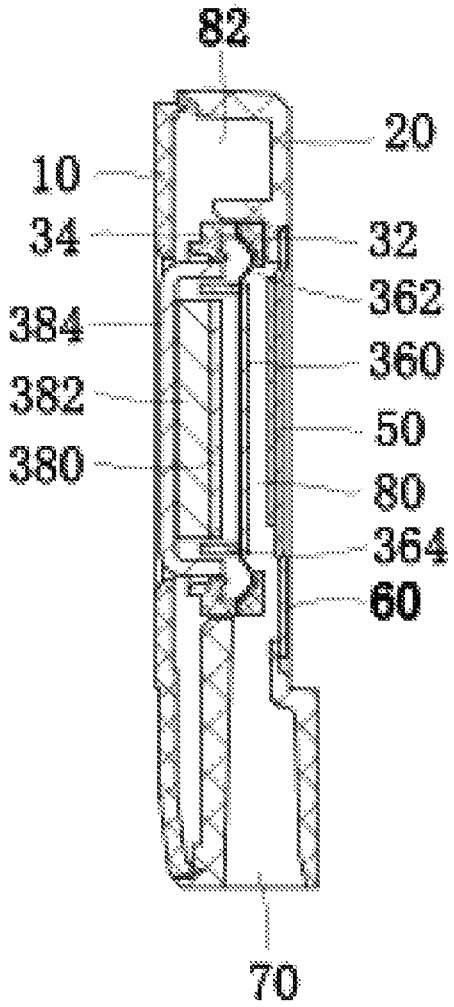
FIG. 4 is a sectional enlarged view of a line B-B in FIG. 3, in which reference signs are as follows: 10, module upper housing; 12, mounting hole; 14, positioning column; 16, ultrasonic wire; 20, module upper housing; 22, joint portion; 30, single speaker piece; 32, single front cover piece; 34, single housing piece; 340, wire outgoing slot; 360, dome; 362, diaphragm; 364, voice coil; 366, voice coil wire; 380, washer; 382, magnet; 384, basin frame; 40, FPCB; 42, positioning hole; 44, inner connection portion; 50, thin sheet; 60, steel sheet; 62, recess portion; 70, sound aperture; 80, front acoustic cavity; 82, rear acoustic cavity; 90, adhesive accommodating slot.

As illustrated together in FIGS. 1, 3 and 4, a speaker module comprises a housing. The housing comprises a module lower housing 10, a module upper housing 20 and a steel sheet 60 which are jointed together in sequence. A single speaker piece 30 is accommodated in a space enclosed by the module lower housing 10, the module upper housing 20 and the steel sheet 60 together. The single speaker piece 30 separates an inner cavity of the entire module into a front acoustic cavity 80 and a rear acoustic cavity 82. The single speaker piece 30, the module upper housing 20 and the steel sheet 60 together enclose the front acoustic cavity 80. The single speaker piece 30, the module upper housing 20 and the module lower housing 10 together enclose the rear acoustic cavity 82. A sound aperture 70 of the module is provided in a lateral portion of the single speaker piece 30 and located in a sidewall at one side of the module upper housing 20. The front acoustic cavity 80 is communicated with the sound aperture 70.

As illustrated together in FIG. 1 and FIG. 4, the single speaker piece 30 comprises a single front cover piece 32 and a single housing piece 34 which are jointed together. A vibrating system and a magnetic circuit system are accommodated in a space enclosed by the single front cover piece 32 and the single housing piece 34. The vibrating system comprises a diaphragm 362 of which an edge portion is fixed between the single front cover piece 32 and the single housing piece 34. A dome 360 is fixed at the middle part of one side, close to the single front cover piece 32, of the diaphragm 362. A voice coil 364 is fixed at the other side of the diaphragm 362. The magnetic circuit system comprises a basin frame 384 fixed at the inner side of the single housing piece 34. A magnet 382 and a washer 380 are sequentially fixed at the inner side of the basin frame 384. A magnetic gap in which the end part of the voice coil 364 is located is provided between the magnet 382 as well as the washer 380 and a sidewall of the basin frame 384. The module further comprises a FPCB (Flexible Printed Circuit Board) 40 for electrically connecting the voice coil 364 and an external circuit of the module. The FPCB 40 transmits an acousto-electric signal to the voice coil 364. The voice coil 364 reciprocates vertically inside the magnetic gap according to amplitude and direction of the received acousto-electric signal. The diaphragm 362 and the dome 360 vibrate along with the vertical movement of the voice coil 364 to instigate the air to sound, thus completing the electro-acoustic energy conversion.

As illustrated together in FIG. 1 and FIG. 4, a recess portion 62 which extends towards the inner cavity of the module and is 0.1 mm to 0.2 mm deep is provided at a position, corresponding to the dome 360, of the steel sheet 60. In the present embodiment, the recess portion 62 is preferably 0.15 mm deep. The recess portion 62 is provided with a protrusion, which is 0.15 mm high, inside the front acoustic cavity 80. The recess portion 62 is processed by a stamping process. A thin sheet 50 is adhered to a position (i.e., a position where the protrusion is located), where the recess portion 62 is located, at the inner side of the steel sheet 60. The thin sheet 50 is also 0.1 mm to 0.2 mm thick. In the present embodiment, the thin sheet 50 is preferably 0.15 mm thick. The thin sheet 50 is made of PET (Polyethylene terephthalate, thermoplastic polyether), bakelite, Acrylic or other sound insulation materials. Since the PET is relatively low in cost, the thin sheet 50 in the present embodiment is made of PET. The recess portion 62 formed by stamping is provided on the steel sheet 60, and a thin sheet 50 is adhered to the inner side of the recess portion 62. In addition, both the depth of the recess portion 62 and the thickness of the thin sheet 50 are 0.15 mm. The recess portion 62 and the thin sheet 50 are superposed inside the front acoustic cavity 80 to form a protrusion which is 0.3 mm high. The protrusion having this height ensures that no resonance occurs in the front acoustic cavity 80 and that the volume of the front acoustic cavity 80 is effectively reduced, thereby improving the medium and high frequency performances of the module and further improving the overall acoustic performance of the module. In the present embodiment, the thin sheet 50 is preferably away from the sound aperture 70 and thus cannot affect the sound channel area at the sound aperture, thereby being capable of ensuring smooth flow of sound waves and also ensuring that the acoustic performance of the module is not affected.

As illustrated together in FIGS. 1, 3 and 4, the steel sheet 60 is adhesively jointed with the module upper housing 20. A joint portion 22 which is recessed downwards is provided at a position where the module upper housing 20 is jointed with the steel sheet 60. The steel sheet 60 is adhered to the joint portion 22, where an outer surface of the steel sheet 60 is flush with an outer surface of the module upper housing or slightly lower than the outer surface of the module upper housing 20. Preferably, a gap is provided between a sidewall of the joint portion 22, close to the sound aperture 70 side, and a sidewall of the steel sheet 60, that is, in this position, the region of the joint portion is larger than the steel sheet 60. The gap between the sidewall of the joint portion 22 and the sidewall of the steel sheet 60 forms an adhesive accommodating slot 90. The joint portion 22 is provided to reduce the thickness of the module, and simultaneously increases a contact area between the steel sheet 60 and the module upper housing 20 and enhances the joint strength between the steel sheet 60 and the module upper housing 20. The adhesive accommodating slot 90 is provided to increase the adhesive application amount between the steel sheet 60 and the module upper housing 20 to further enhance the joint strength between the steel sheet 60 and the module upper housing 20, to effectively reduce the probability of the steel sheet 60 cracking or falling off from the module upper housing 20, to enhance the stability of the module and to prolong the service life of the module.

Figure 2:
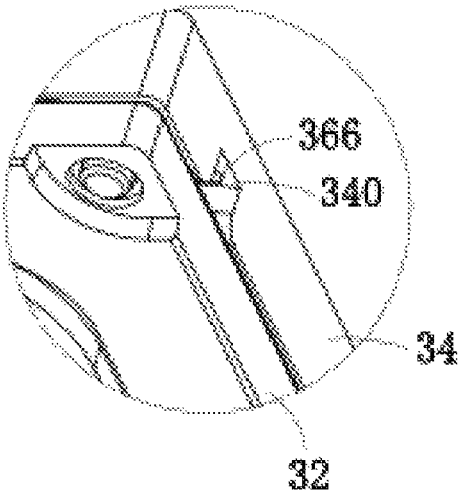
FIG. 2 is an enlarged view of a portion A in FIG. 1.

As illustrated together in FIGS. 1, 2 and 3, the FPCB 40 is provided at a lateral portion of a short edge of the single speaker piece 30. A sidewall at this side of the single speaker piece 34 is provided with two wire outgoing slots 34. Two voice coil wires 366 of the voice coil 364 extend out from the two wire outgoing slots 340 respectively. Two inner connection portions 44 are provided at positions, corresponding to the two wire outgoing slots 340, of the FPCB 40. The two voice coil wires 366 are electrically connected with the two inner connection portions 44, respectively. A bonding pad which is electrically connected with an external circuit of the module is provided at the other end of the FPCB 40. In the position corresponding to where the bonding pad is provided, the module upper housing 20 of the FPCB 40 is provided with an opening from which the bonding pad is exposed out of the inner cavity of the module and is electrically connected with the external circuit of the module. Two positioning columns 14 are provided at the inner side, corresponding to a position where the FPCB 40 is located, of the module lower housing 10. A positioning hole 42 which is adaptive with the positioning column 14, is formed in each of positions, corresponding to the two positioning columns 14, of the FPCB 40. The positioning holes 42 together with the bonding pad are exposed out of the inner cavity of the module. The FPCB 40 is fixed on the module lower housing 10 via the positioning columns 14 and the positioning holes 42.

As illustrated together in FIG. 1 and FIG. 4, the single housing piece 34 is of an annular structure having two open ends. The upper open end of the single housing piece 34 is jointed with the single front cover piece 32. A magnetic circuit system is mounted at the lower open end of the single housing piece. The bottom of the basin frame 384 is exposed to the lower open end of the single housing piece 34, and the outer surface of the bottom of the basin frame 384 protrudes out of the lower end surface of the single housing piece 34. A mounting hole 12 which is adaptive with the size and shape of the bottom of the basin frame 384 is formed in a position, corresponding to the bottom of the basin frame 384, of the module lower housing 10. After the module is completely assembled, the bottom of the basin frame 384 is located at the mounting hole 12, and the outer surface of the bottom of the basin frame 384 is flush with the outer surface of the module lower housing 10. This structure effectively reduces the thickness of the module, making the module to meet the requirements of a thin, compact electronic device.

As illustrated together in FIG. 1 and FIG. 4, an ultrasonic wire 16 is provided at a position where an edge portion at the inner side of the module lower housing 10 is jointed with the module upper housing 20. The module lower housing 10 and the module upper housing 20 are jointed into a whole by an ultrasonic welding process.

According to the speaker module of the present invention, the thin sheet which is made of a sound insulation material is adhered to the inner wall of the front acoustic cavity to reduce the volume of the front acoustic cavity, thereby promoting the medium and high frequency performances of the module on the premise of not changing structures of various components of the module, and improving the overall acoustic performance of the module.

The present description is merely a detailed example of a technical solution of the present invention, in which the thin sheet made of a sound insulation material is attached in the front acoustic cavity, by using the module having the above-described structure as an example. In actual applications, this technical solution is not only suitable for the speaker module with the structure described above, but also applicable to any speaker module having a structure of emitting sound laterally. Those skilled in the art will be able to apply the technical solution of the present invention to other modules having a structure of emitting sound laterally according to the representation of the present description, without paying creative work. Therefore, regardless of whether the other structure of the module is the same as the module structure in the above embodiment, all of the speaker modules in which a thin sheet made of a sound insulation material is adhered to a front acoustic cavity to reduce the volume of the front acoustic cavity and improve the medium and high frequency performances of the module shall fall within the protection scope of the present invention.

The present invention is not limited to the specific embodiments described above, and various changes that have been made by those common skilled in the art from the above concept without creative work shall fall within the protection scope of the present invention.

The invention claimed is:

1. A speaker module comprising:

a module lower housing;

a module upper housing; and a steel sheet, wherein:

the module lower housing, the module upper housing, and the steel sheet are jointed together in sequence;

a single speaker piece is accommodated in a space enclosed by the module lower housing, the module upper housing and the steel sheet;

the single speaker piece, the module upper housing and the steel sheet together enclose a front acoustic cavity of the module;

the front acoustic cavity is in communication with a sound aperture of the module;

the sound aperture is positioned in a lateral portion of the single speaker piece; and a thin sheet made of a sound insulation material and being 0.1 mm to 0.2 mm thick is adhered to the inner side of the steel sheet.

2. The speaker module according to claim 1, wherein:

a recess portion that extends towards an inner cavity of the module and is 0.1 mm to 0.2 mm deep is provided at a position, corresponding to the single speaker piece, of the steel sheet, and the thin sheet is adhered to a position where the recess portion is located.

3. The speaker module according to claim 2, wherein the thin sheet is positioned away from the sound aperture.

4. The speaker module according to claim 3, wherein the thin sheet and the recess portion are each 0.15 mm thick.

5. The speaker module according to claim 1, wherein the sound insulation material is selected from one of PET, bakelite, or Acrylic.

6. The speaker module according to claim 5, wherein:

the steel sheet is adhesively jointed with the module upper housing;

a joint portion which is recessed downwards is provided at a position where the module upper housing is jointed with the steel sheet; and the steel sheet is adhered to the joint portion where an outer surface of the steel sheet is flush with an outer surface of the module upper housing or is slightly lower than the outer surface of the module upper housing.

7. The speaker module according to claim 6, wherein:

the sound aperture is provided in a lateral portion of the module upper housing; and a gap, which forms an adhesive accommodating slot, is provided between a sidewall of the joint portion, close to the sound aperture side, and a sidewall of the steel sheet.

8. The speaker module according to claim 7, wherein:

the single speaker piece comprises a single front cover piece and a single housing piece which are jointed together;

a vibrating system and a magnetic circuit system are accommodated inside a space enclosed by the single front cover piece and the single housing piece;

the single housing piece is of an annular structure having two open ends; and a bottom of a basin frame of the magnetic circuit system is exposed to a lower open end of the single housing piece.

9. The speaker module according to claim 8, wherein:

an outer surface of the bottom of the basin frame protrudes out of a lower end surface of the single housing piece;

a mounting hole which is adaptive with the bottom of the basin frame is provided in a position, corresponding to the bottom of the basin frame, of the module lower housing;

the bottom of the basin frame is positioned at the mounting hole; and the outer surface of the bottom of the basin frame is flush with the outer surface of the module lower housing.

10. The speaker module according to claim 9, wherein:

a sidewall at one side of the single housing piece is provided with two wire outgoing slots; and two wires of a voice coil of the vibrating system extend out from the two wire outgoing slots respectively and are electrically connected with the FPCB.

* * * * *